US006006679A

United States Patent [19]

Lin

[11] Patent Number: 6,006,679

[45] Date of Patent: Dec. 28, 1999

[54] TABLE ASSEMBLY

[76] Inventor: Steve Lin, No. 80, Kengtsai Pin, Hoping Village, Chuchi Hsiang, Chiayi Hsien, Taiwan

[21] Appl. No.: 09/199,393

[22] Filed: Nov. 25, 1998

[51] Int. Cl.[6] ..... A47B 3/06

[52] U.S. Cl. ..... 108/157.15; 108/27

[58] Field of Search ..... 108/27, 157.18, 108/159.11, 157.15, 157.1, 157.16; 248/188, 222.31, 231.31, 231.71, 231.81

[56] References Cited

U.S. PATENT DOCUMENTS

| | | | |
|---|---|---|---|
| 2,628,141 | 2/1953 | Scheuer | 108/157.18 X |
| 4,317,416 | 3/1982 | Baum et al. | 108/157.1 |
| 4,503,780 | 3/1985 | Apissomian | 108/27 |
| 4,754,714 | 7/1988 | Drumm | 108/157.18 |
| 4,805,541 | 2/1989 | Drane et al. | 108/157.15 X |
| 4,823,709 | 4/1989 | Tesney | 108/157.15 |
| 4,905,612 | 3/1990 | Apissomian | 108/157.15 |
| 4,941,413 | 7/1990 | Vanderminden | 108/157.15 |
| 5,404,828 | 4/1995 | Tesney | 108/27 |
| 5,551,352 | 9/1996 | Meier et al. | 108/27 |

*Primary Examiner*—Jose V. Chen
*Attorney, Agent, or Firm*—William E. Pelton, Esq.

[57] ABSTRACT

A table assembly includes a tabletop including an annular frame, a top having the periphery thereof received in the annular frame, a plurality of L-shaped connectors each having a vertical section received in the annular frame and abutting the bottom surface of the top, and a horizontal section extending outward from the annular frame, and a leg module mounted under the tabletop and including a plurality legs each having its upper end portion detachably secured to the horizontal section of one of the corresponding connectors.

5 Claims, 7 Drawing Sheets

TABLE ASSEMBLY

CROSS-REFERENCES TO RELATED APPLICATIONS

Not Applicable.

BACKGROUND OF THE INVENTION

1. Field of the Invention

The present invention relates to a table assembly, and more particularly to a table assembly easily assembled and dismantled.

2. Description of the Related Art

A conventional table assembly in accordance with the prior art shown in FIGS. 7 and 8 comprises a tabletop (50) including an annular frame (52), a top (51) having the periphery thereof received in the annular frame (52), and a plurality of cushions (53) each securely received in the annular frame (52) and each abutting the bottom surface of the top (51), and a leg module (60) mounted under the tabletop (50) and including a plurality legs (61) each having its upper end portion secured to the annular frame (52). The annular frame (52) includes a plurality of ears (54) extending laterally from the lower portion thereof and containing a hole (55), and each of the legs (61) includes a threaded post (62) extending upward from the upper end portion thereof and extending through the hole (55), and a locking nut (65) screwed onto the threaded post (62) to secure the tabletop (50) on the leg module (60). However, such an arrangement, requires a tool to unscrew the locking nut (65) from the threaded post (62) such that the tabletop (50) is not easily mounted to and detached from the leg module (20), thereby making assembly and disassembly of the table difficult. The present invention has arisen to mitigate and/or obviate the disadvantage of the conventional table assembly.

BRIEF SUMMARY OF THE INVENTION

In accordance with one aspect of the present invention, there is provided a table assembly comprising a tabletop including an annular frame, a top having the periphery thereof received in the annular frame, a plurality of L-shaped connectors each having a vertical section received in the annular frame and abutting the bottom surface of the top, and a horizontal section extending outward from the annular frame, and a leg module mounted under the tabletop and including a plurality of legs each having its upper end portion detachably secured to the horizontal section of one of the corresponding connectors.

In accordance with another aspect of the present invention, the horizontal section of the connector contains an elongate guide slot, and a hole connecting to the guide slot and has a dimension greater than that of the guide slot, and the leg module further includes a stub extending upward from the upper end portion of each of the legs and slidably received in the guide slot, and a large head formed on the stub and abutting the top of the guide slot.

In accordance with a further aspect of the present invention, the annular frame contains a retaining groove formed in the lower portion thereof, and the vertical section of each of the connectors includes an abutting flange extending downward and received in the retaining groove.

Further benefits and advantages of the present invention will become apparent after a careful reading of the detailed description with appropriate reference to the accompanying drawings.

DETAILED DESCRIPTION OF THE INVENTION

Figure 1:
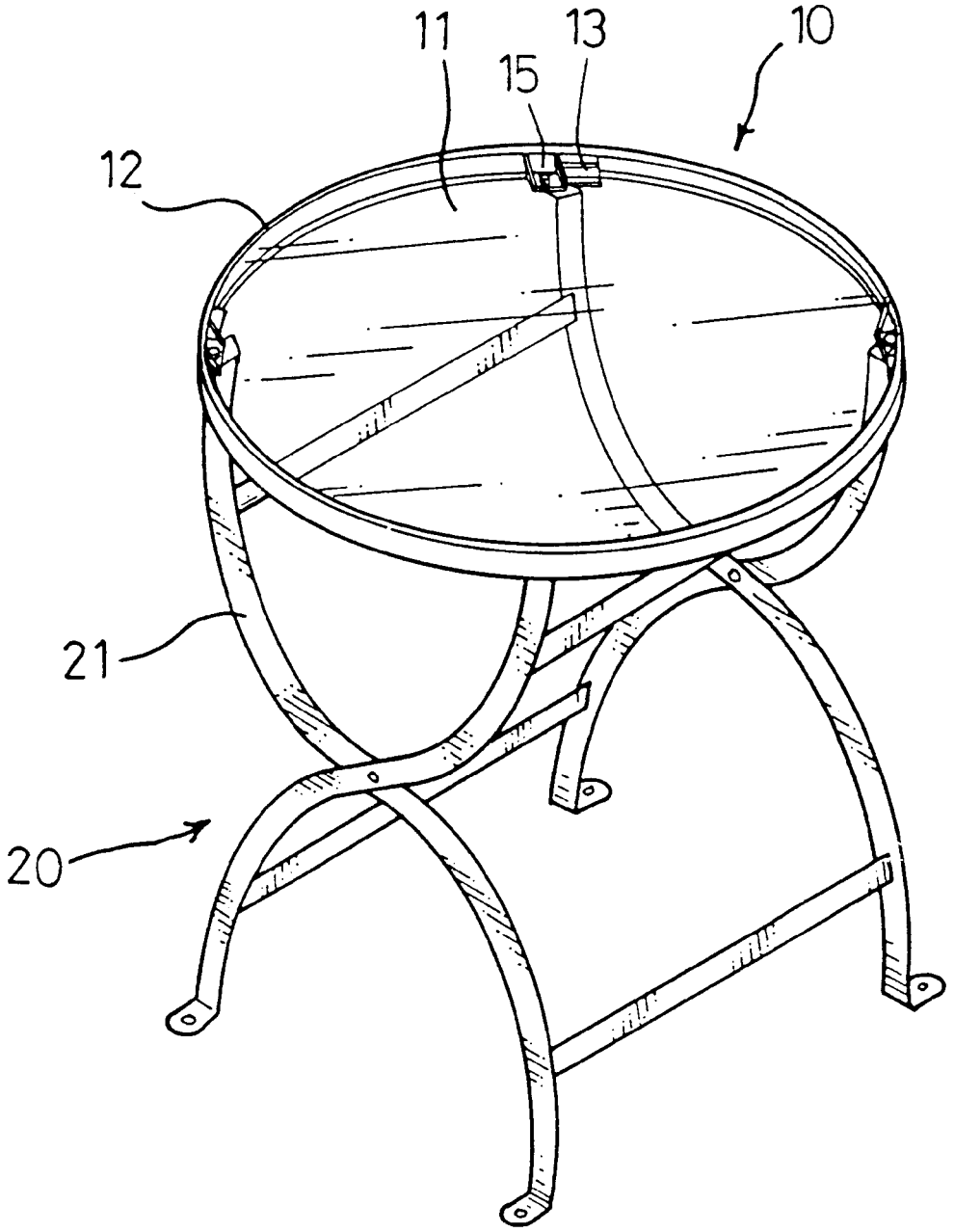
FIG. 1 is a perspective view of a table assembly in accordance with the present invention.

Referring now to FIGS. 1–5, a table assembly in accordance with the present invention comprises a tabletop (10) including an annular frame (12), a top (11) having the periphery thereof received in the annular frame (12), and a plurality of substantially L-shaped connectors (14) each including a vertical section (15) received in the annular frame (12) and abutting the bottom surface of the top (11), and a horizontal section (16) extending outward from the annular frame (12), and a leg module (20) mounted under the tabletop (10) and including a plurality legs (21) each having its upper end portion (210) detachably secured to the horizontal section (16) of one of the corresponding connectors (14).

The horizontal section (16) of each of the connectors (14) contains an elongate guide slot (160), and a hole (162) connecting to the guide slot (160) and having a dimension greater than that of the guide slot (160), and the leg module (20) further includes a stub (22) extending upward from the upper end portion (210) of each of the legs (21) and slidably received in the guide slot (160), and an enlarged head (23) formed on the stub (22), the bottom of which abuts the top of the guide slot (160) when the stub (22) is engaged in the elongated guide slot (160). The enlarged head (23) has a dimension greater than that of the guide slot (160) and slightly smaller than that of the hole (162).

The annular frame (12) contains a retaining groove (120) formed in the lower portion thereof, and the vertical section (15) of each of the connectors (14) includes an abutting flange (150) extending downward and received in the retaining groove (120).

The table assembly further comprises a plurality of cushions (13) each securely received in the annular frame (12) and each abutting the bottom surface of the top (11) so that the the frame (12) and the cushion (13) secure the top (11) in position.

Figure 2:
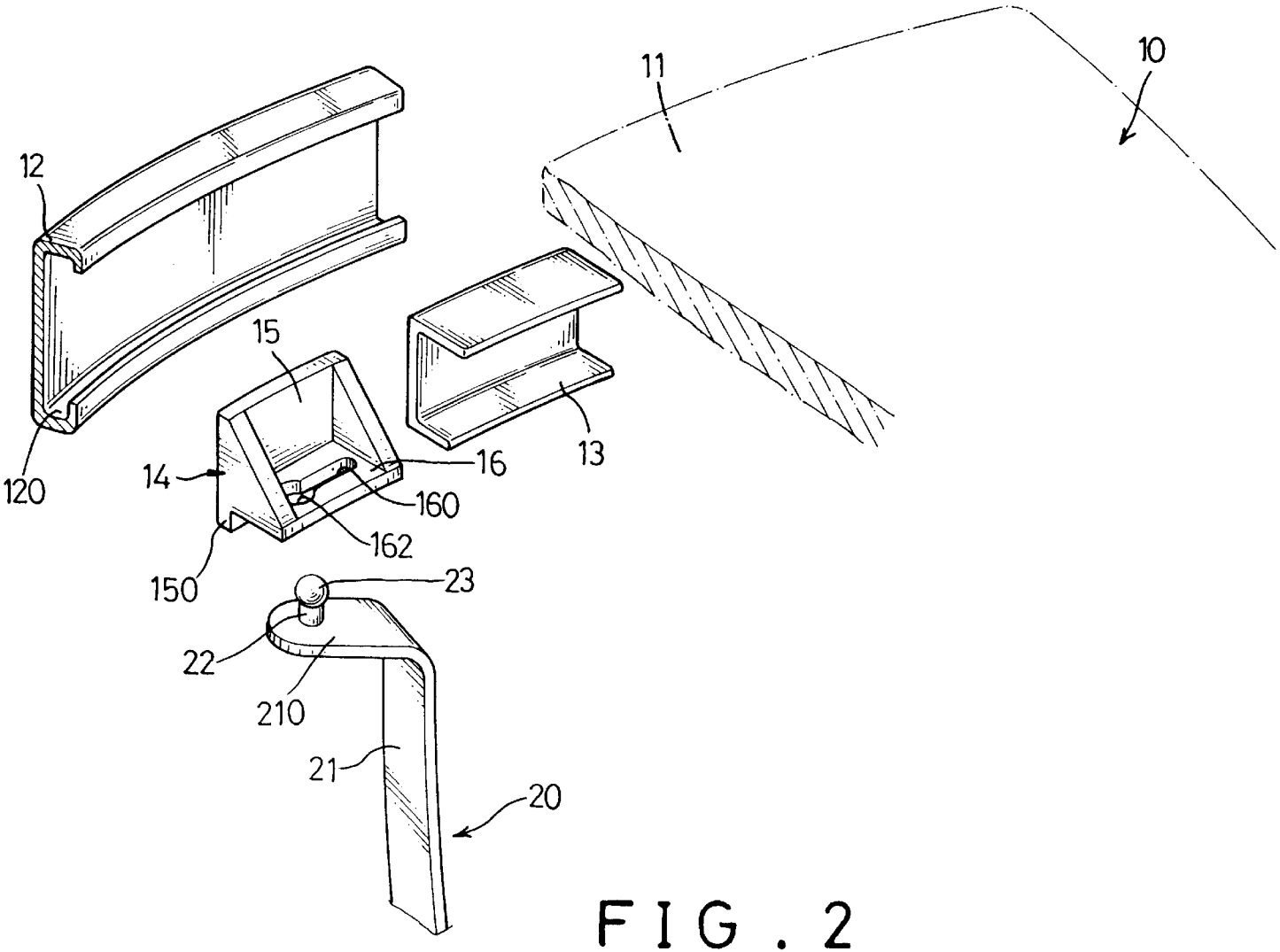
FIG. 2 is a perspective exploded view of the table assembly as shown in FIG. 1.
Figure 3:
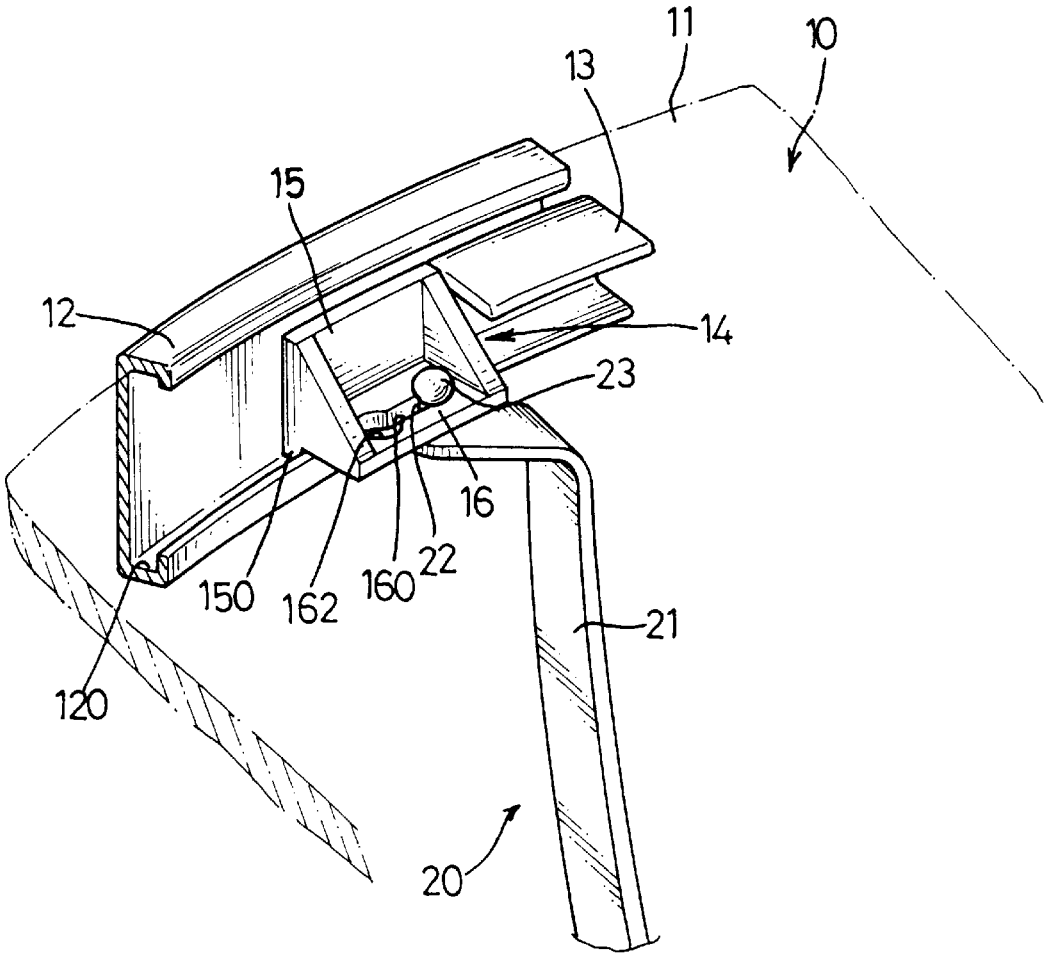
FIG. 3 is an assembly view of the table assembly as shown in FIG. 2.
Figure 5:
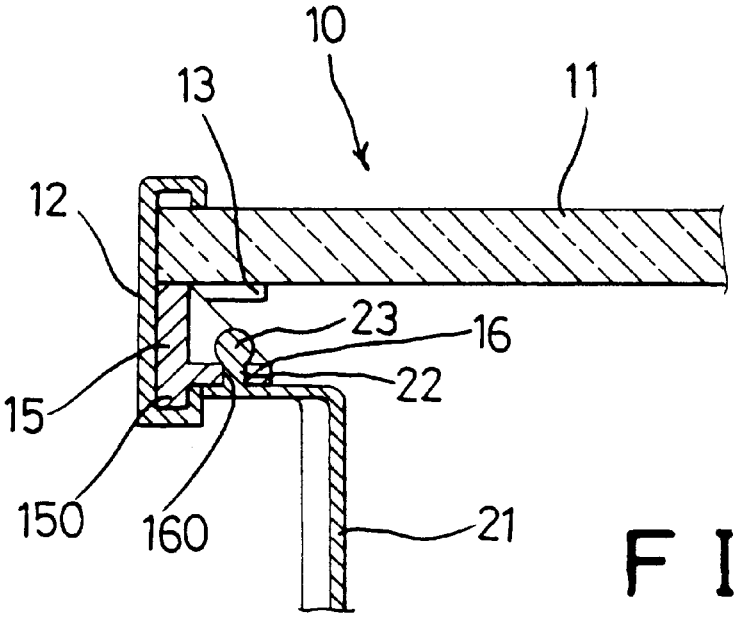
FIG. 5 is front plan cross-sectional view of the table assembly as shown in FIG. 3.
Figure 4:
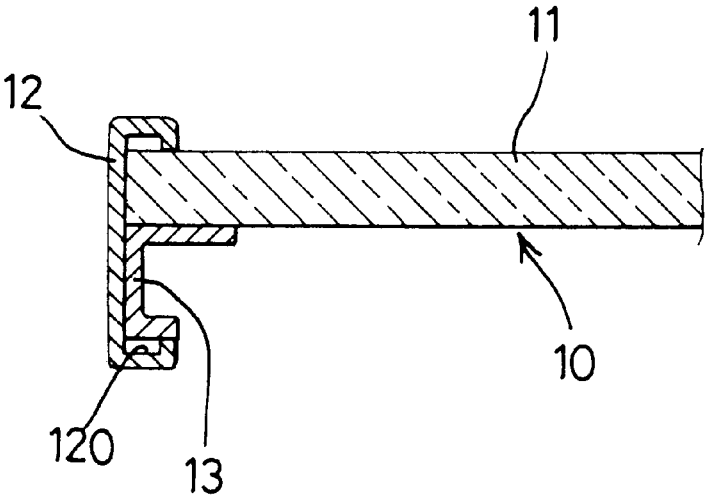
FIG. 4 is front plan cross-sectional view of the table assembly as shown in FIG. 3.
Figure 6:
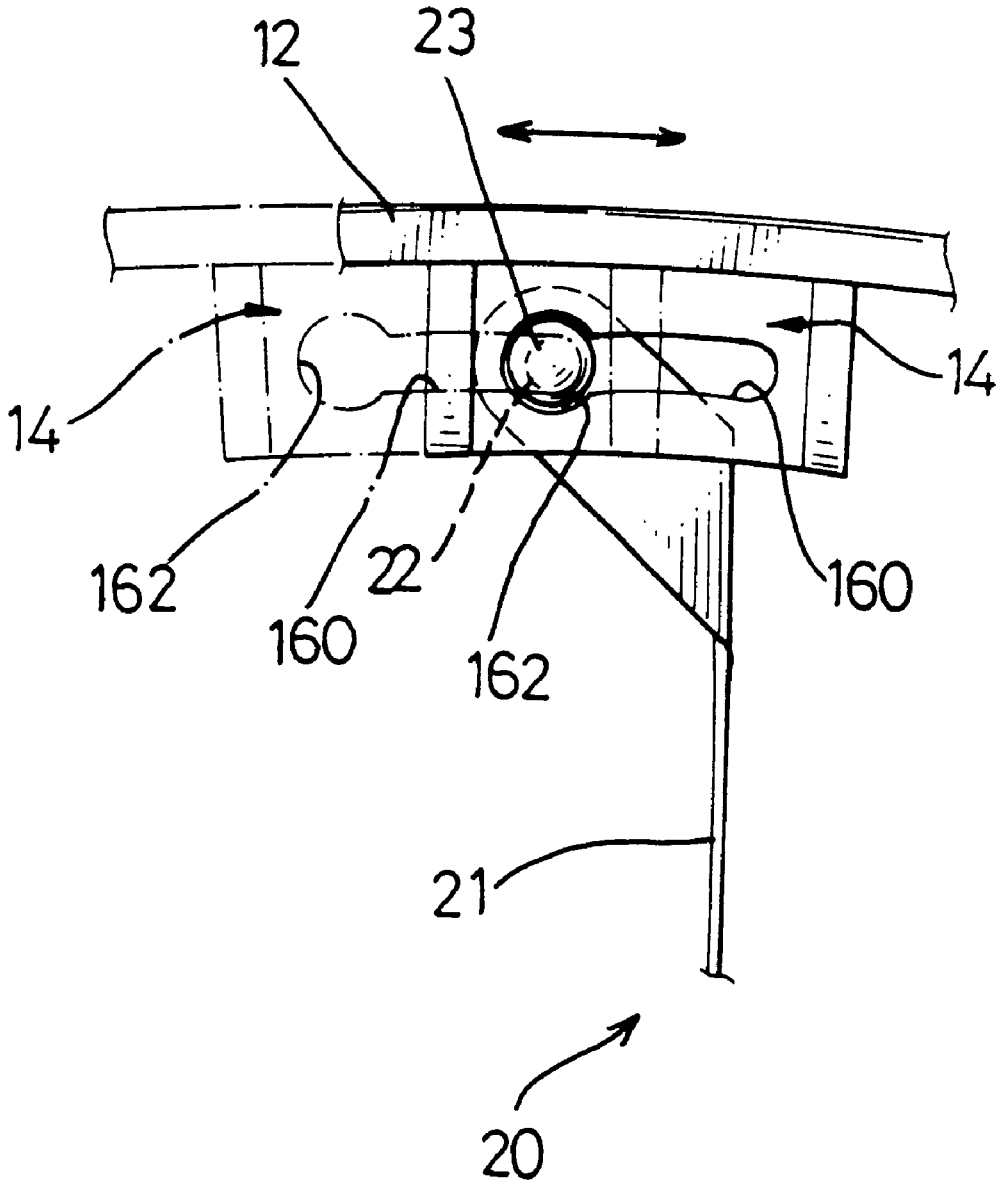
FIG. 6 is side plan operational view of the table assembly as shown in FIG. 3.
Figure 7:
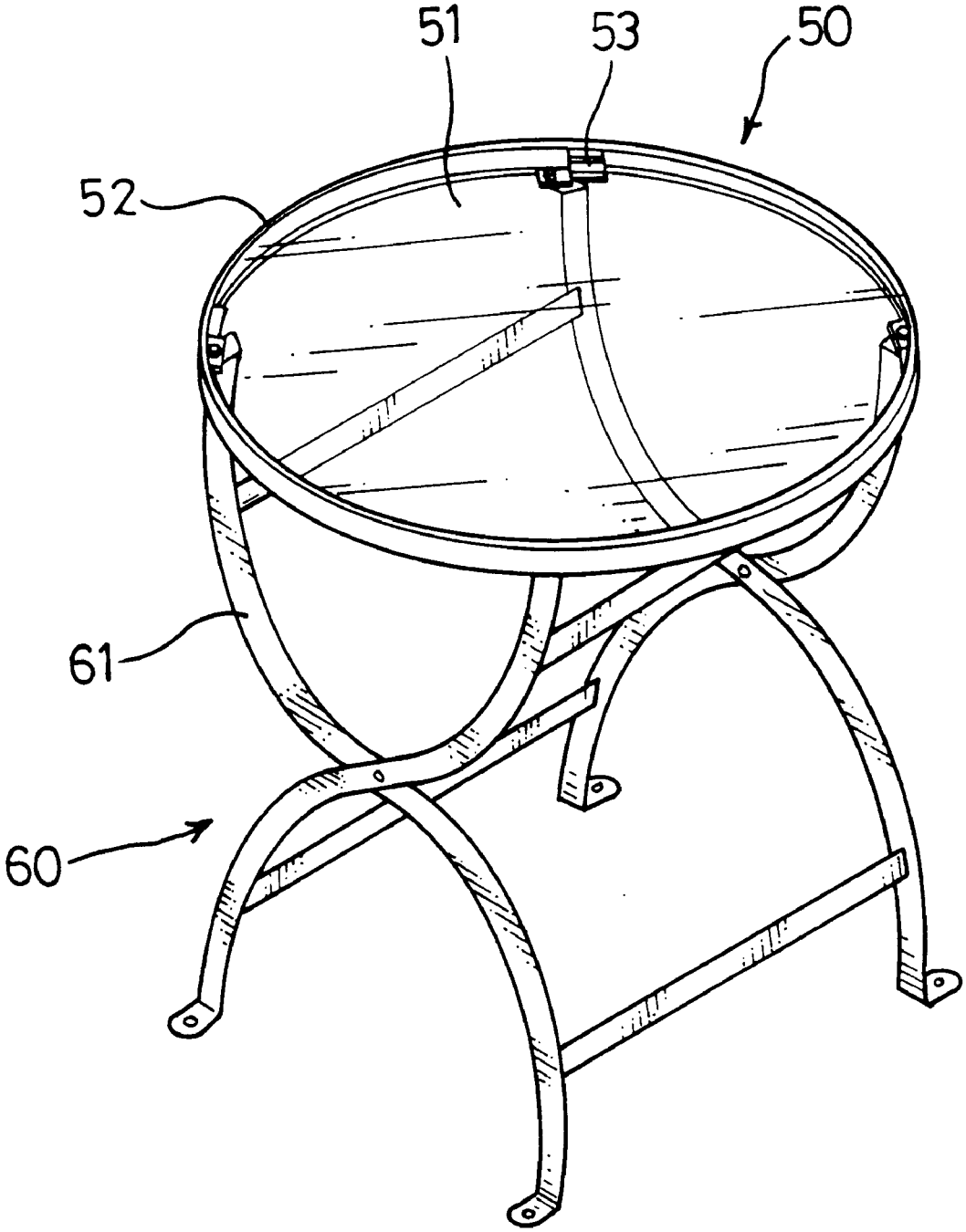
FIG. 7 PRIOR ART
FIG. 7 is a perspective view of a conventional table assembly in accordance with the prior art.
Figure 8:
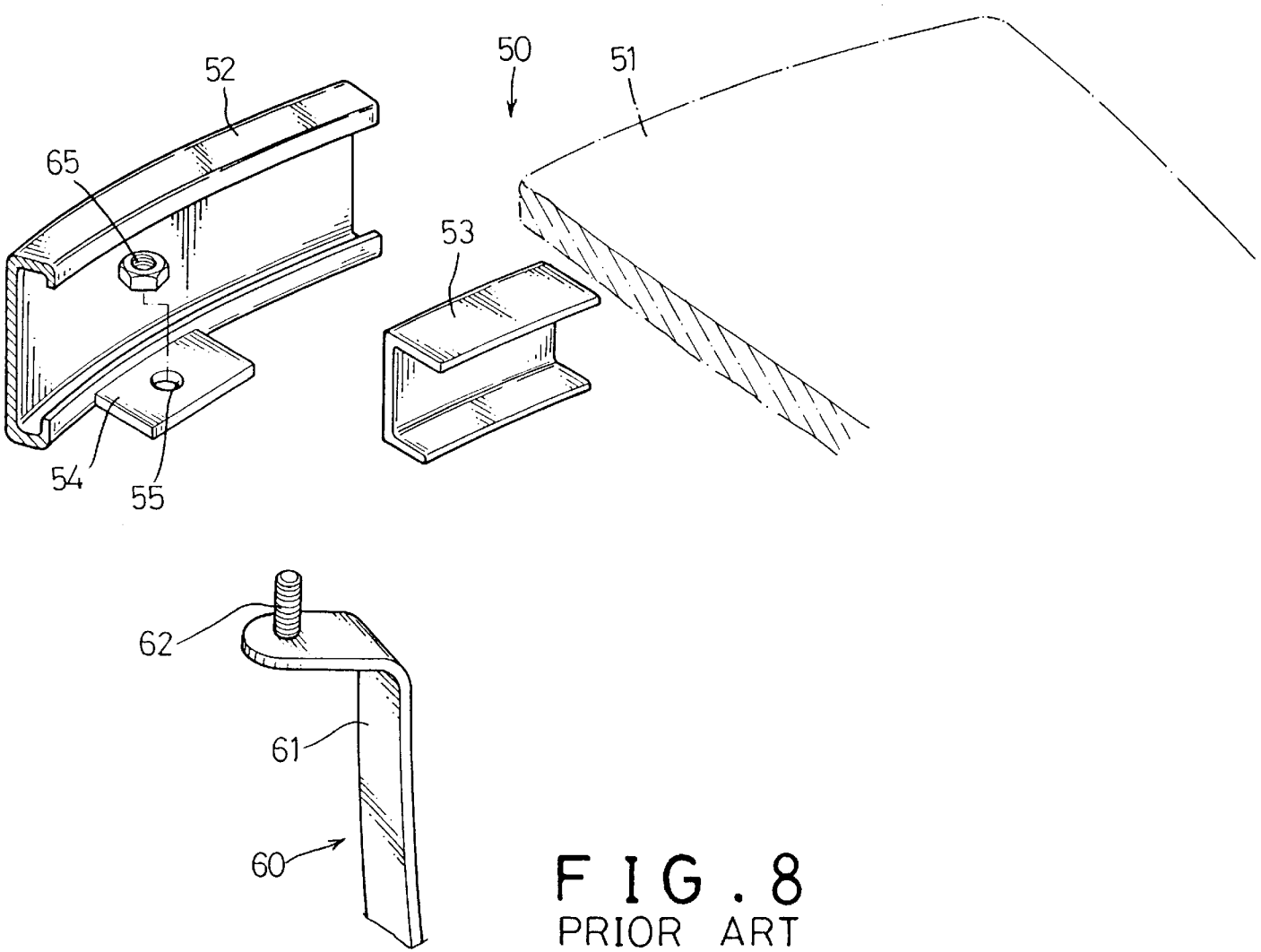
FIG. 8 PRIOR ART
FIG. 8 a perspective exploded view of the conventional table assembly as shown in FIG. 7.

In assembly, referring to FIG. 6 with reference to FIGS. 1–3, each of the legs (21) can be attached to the respective connector (14) with the enlarged head (23) together with the stub (22) being moved to extend through the hole (162).

Each of the connectors (14) can be moved relative to the respective leg (21) by means of rotating the tabletop (10) such that the stub (22) together with the enlarged head (23) is moved from the hole (162) into the guide slot (160), thereby locking the large head (23) on the guide slot (160) as shown in FIG. 3 such that the tabletop (10) is securely attached to the leg module (20).

Each of the connectors (14) can be moved relative to the respective leg (21) in the reverse direction by rotating the tabletop (10) such that the stub (22) together with the enlarged head (23) is moved from the guide slot (160) into the hole (162), thereby being able to detach the enlarged head (23) together with the stub (22) from the hole (162) such that the tabletop (10) is detached from the leg module (20).

In such a manner, the tabletop (10) is easily mounted to and detached from the leg module (20) such that the table assembly can be easily assembled and dismantled, thereby greatly facilitating a user assembling and dismantling the table assembly.

It should be clear to those skilled in the art that further embodiments may be made without departing from the scope and spirit of the present invention.

What is claimed is:

1. A table assembly comprising:

A tabletop including an annular frame, a top having the periphery thereof received in said annular frame, and a plurality of L-shaped connectors each having a vertical section received in said annular frame and abutting the bottom surface of said top, and a horizontal section extending outward from said annular frame, said horizontal section containing an elongated guide slot, and a hole connecting to said guide slot and having a dimension greater than that of said guide slot; and a leg module mounted under said tabletop and including a plurality of legs each having its upper end portion detachably secured to said horizontal section of one of said corresponding connectors, a stub extending upward from said upper end portion of each of said legs and slidably received in said guide slot, and an enlarged head formed on said stub, said enlarged head having its bottom abutting the top of said guide slot when said stub is engaged in said elongated guide slot.

2. The table assembly in accordance with claim 1, wherein said enlarged head has a dimension greater than that of said guide slot.

3. The table assembly in accordance with claim 1, wherein said enlarged head has a dimension smaller than that of said hole.

4. The table assembly in accordance with claim 1, wherein said annular frame contains a retaining groove formed in the lower portion thereof, and said vertical section of each of said connectors includes an abutting flange extending downward and received in said retaining groove.

5. The table assembly in accordance with claim 1, further comprising a plurality of cushions each securely received in said annular frame and each abutting the bottom surface of said top.

* * * * *